US008646632B2

(12) United States Patent
Vischer et al.

(10) Patent No.: US 8,646,632 B2
(45) Date of Patent: Feb. 11, 2014

(54) MOUTHPIECE AND PROCESS FOR PRODUCTION

(75) Inventors: Peter Vischer, Küssnacht am Rigi (CH); Beda Weber, Sins (CH); Erich Pfenniger, Ebikon (CH); Stefan Baumann, Altdorf (CH)

(73) Assignee: Medela Holding AG, Baar (CH)

( * ) Notice: Subject to any disclaimer, the term of this patent is extended or adjusted under 35 U.S.C. 154(b) by 138 days.

(21) Appl. No.: 12/864,552

(22) PCT Filed: Jan. 27, 2009

(86) PCT No.: PCT/CH2009/000032
§ 371 (c)(1),
(2), (4) Date: Jul. 26, 2010

(87) PCT Pub. No.: WO2009/097702
PCT Pub. Date: Aug. 13, 2009

(65) Prior Publication Data

US 2010/0308002 A1 Dec. 9, 2010

(30) Foreign Application Priority Data

Feb. 5, 2008 (CH) ..... 157/08

(51) Int. Cl.
*A61J 11/00* (2006.01)
*A61J 17/00* (2006.01)

(52) U.S. Cl.
USPC ..... 215/11.1; 215/11.6; 604/74; 604/77; 604/78; 604/79; 128/859; 128/861; 128/862; 220/714; 264/328.18; 264/257; 222/490

(58) Field of Classification Search
USPC ..... 215/11.1–11.6; 426/117; D24/194, D24/110.5; 604/77, 78, 79; 520/1; 528/10, 528/25; 264/632, 640, 641, 642, 328.18, 264/257, 328.12, 108; 443/93; 128/859, 128/861, 862; 433/6; 602/902; 43/93; 606/234–236; 220/714; 222/490
IPC ..... A61J 9/00
See application file for complete search history.

(56) References Cited

U.S. PATENT DOCUMENTS 167,613 A * 9/1875 Knapp ..... 215/11.1
1,236,235 A * 8/1917 Tufts ..... 606/236

(Continued)

FOREIGN PATENT DOCUMENTS

CN 1324230 11/2001
DE 202005001043 11/2006

(Continued)

OTHER PUBLICATIONS

Zainudin, E.S. Fiber Orientation of Short Fiber Reinforced Injection Molded Thermoplastic Composites: A Review. marc 2002. Journal of Injection Molding Technology.*

(Continued)

*Primary Examiner* — Mickey Yu
*Assistant Examiner* — Gideon Weinerth
(74) *Attorney, Agent, or Firm* — McDonnell Boehnen Hulbert & Berghoff LLP

(57) ABSTRACT

A mouthpiece has a bite-off-prevention feature. The mouthpiece has been manufactured from an elastomeric parent material with at least one first component, where a reinforcing component embedded within the parent material forms the bite-off-prevention feature and derives from the same group of substances or group of materials as the first component. The reinforcing component is preferably composed of fibers.

8 Claims, 6 Drawing Sheets

(56) References Cited

U.S. PATENT DOCUMENTS

| | | | | |
|---|---|---|---|---|
| 2,001,842 | A * | 5/1935 | Heise et al. | 215/11.1 |
| 2,040,545 | A * | 5/1936 | Byers | 222/488 |
| 3,224,441 | A | 12/1965 | Monaghan | |
| 3,317,455 | A * | 5/1967 | Blome et al. | 523/219 |
| 3,488,747 | A * | 1/1970 | Cleereman | 264/312 |
| 3,655,863 | A * | 4/1972 | Andersen | 264/294 |
| 4,063,552 | A * | 12/1977 | Going et al. | 128/861 |
| 4,076,684 | A * | 2/1978 | Wohlfarth et al. | 524/861 |
| 4,102,831 | A * | 7/1978 | Osgood | 521/99 |
| 4,950,286 | A * | 8/1990 | Meussdoerffer | 606/236 |
| 4,988,470 | A * | 1/1991 | Demlehner et al. | 264/137 |
| 5,061,423 | A * | 10/1991 | Layden | 264/108 |
| 5,093,050 | A * | 3/1992 | Tepic | 264/415 |
| 5,198,167 | A * | 3/1993 | Ohta et al. | 264/86 |
| 5,275,776 | A * | 1/1994 | Hara et al. | 264/257 |
| 5,580,512 | A * | 12/1996 | Koon et al. | 264/438 |
| 5,673,806 | A * | 10/1997 | Busnel | 215/11.1 |
| 5,939,178 | A * | 8/1999 | Boich | 428/198 |
| 6,010,656 | A | 1/2000 | Nomura et al. | |
| 6,241,110 | B1 * | 6/2001 | Hakim | 215/11.1 |
| 6,745,912 | B2 * | 6/2004 | Uehara et al. | 215/11.1 |
| 6,750,279 | B1 * | 6/2004 | Wang | 524/380 |
| 6,899,782 | B1 * | 5/2005 | Chang et al. | 156/244.11 |
| 7,395,941 | B2 * | 7/2008 | Hong | 215/11.1 |
| 7,607,439 | B2 * | 10/2009 | Li | 128/860 |
| 7,857,153 | B2 * | 12/2010 | Ito et al. | 215/11.1 |
| 2002/0030029 | A1 | 3/2002 | Hakim | |
| 2005/0156352 | A1 * | 7/2005 | Burkle et al. | 264/257 |
| 2007/0238063 | A1 | 10/2007 | Tesini et al. | |
| 2008/0208254 | A1 * | 8/2008 | Berger et al. | 606/235 |
| 2008/0210655 | A1 * | 9/2008 | Rees et al. | 215/11.5 |
| 2009/0005811 | A1 * | 1/2009 | DuChesne et al. | 606/235 |
| 2009/0248073 | A1 * | 10/2009 | Kliegman et al. | 606/235 |
| 2010/0117265 | A1 * | 5/2010 | Gleich et al. | 264/328.18 |
| 2011/0003140 | A1 * | 1/2011 | Booze et al. | 428/327 |
| 2011/0054527 | A1 * | 3/2011 | Murphy Matro | 606/236 |
| 2012/0022589 | A1 * | 1/2012 | Nipp | 606/234 |

FOREIGN PATENT DOCUMENTS

| | | | |
|---|---|---|---|
| DE | 102006022669 | | 11/2007 |
| EP | 0321845 | | 6/1989 |
| EP | 1666534 | | 6/2006 |
| EP | 1666534 | A1 * | 6/2006 |
| EP | 1293323 | | 7/2010 |
| WO | 00/10505 | | 3/2000 |
| WO | 2007/003494 | | 1/2007 |
| WO | 2007/005427 | | 1/2007 |

OTHER PUBLICATIONS

Sekutowski; Dennis and Liles; Donald. Silicone Rubber Latex and Fillers and Reinforcing Agents. Polymeric Materials Encyclopedia vol. 4 Ed. by Joseph C. Salamone CRC Press 1996.*

International Preliminary Report on Patentability for corresponding PCT Patent Application No. PCT/CH2009/000032.

International Search Report for corresponding International application No. PCT/CH2009/000032 dated May 7, 2009.

* cited by examiner

MOUTHPIECE AND PROCESS FOR PRODUCTION

CROSS REFERENCE TO RELATED APPLICATIONS

The present application claims priority to International Application No. PCT/CH/2009/00032 filed on Jan. 27, 2009, which claims priority to Switzerland Patent Application No. 00157/08 filed on Feb. 5, 2008.

TECHNICAL FIELD

The invention relates to a mouthpiece with a bite-off-prevention feature, and also to a process for the production of a mouthpiece.

BACKGROUND

Mouthpieces for babies and small children, for example teats and suction nipples for bottles, are usually manufactured from a soft elastic parent material. By way of example, elastomers such as silicone or silicone rubber are used for this purpose.

These mouthpieces have to comply with stringent quality requirements, since they are exposed to considerable mechanical stresses. To prevent undesired swallowing of small parts, the design of the mouthpieces must in principle make it impossible for sections to be bitten off by the child. This demands high ultimate tensile strength. In addition, all of the ingredients have to comply with stringent toxicological requirements, and there must be no migration or release of ingredients. Although in polymer chemistry there are well-known additives which increase strength, their admixture to elastomers for mouthpieces of this type is often not permitted.

DE 20 2005 011 043 therefore proposes that these items for sucking and chewing be manufactured from an elasto-meric material which has at least one liquid-crystalline pigment (LC pigment) incorporated for reinforcement.

WO 2007/005427 proposes incorporating network-like reinforcing agents into the suction nipple.

EP 1 666 534 describes a process for the production of fibre-reinforced silicone rubber mouldings by vulcanizing liquid silicones in the presence of short and/or long fibers. The fibres used comprise natural fibres, aramid fibres, carbon fibres or synthetic fibres or a mixture thereof. Synthetic fibre materials mentioned comprise acetate fibres, polyamide fibres, polyester fibres, polyolefin fibres, polyvinyl alcohol fibres and polyurethane fibers. These mouldings are suitable as membranes or seals, and for sheathing and as protective covers, but not for the use mentioned in the sector of babies and small children. The admixture of glass fibres proposed in U.S. Pat. No. 6,010,656 is also unsuitable for the production of mouthpieces.

EP 1 293 323 discloses a process for injection moulding of liquid silicone rubber for the production of suction mouthpieces for babies' bottles and mouthpieces of anaesthesia machines, the intention here being to achieve better mixing of the components. This is achieved by passing a multiple amount of the necessary material through the mixer into a reservoir, and discharging progressively from the reservoir into the injection unit of the injection moulding machine.

DESCRIPTION OF THE INVENTION

It is therefore an object of the invention to provide a mouthpiece which has a bite-off-prevention feature and which complies with the quality requirements for the sector of babies and small children, and which is produced by an efficient and cost-effective method.

The mouthpiece of the invention, with a bite-off-prevention feature, comprises an elastomeric parent material composed of at least one first component, where a reinforcing component embedded within the parent material forms the bite-off-prevention feature and derives from the same group of substances or group of materials as the first component.

Group of substances or group of materials here means by way of example elastomers or thermoplastics.

Component here means a material which derives from one of the above groups of substances or groups of materials.

Since the reinforcement is composed of the same material as one of the components, in particular one of the main components of the parent material, no hazardous additives are introduced. Furthermore, no separate process step is necessary for the introduction of the reinforcing component, and the mouthpiece can therefore be produced by a method which is simple and inexpensive and which saves time. Particularly suitable production processes are injection moulding processes, more particularly single-stage injection moulding processes, compression moulding processes and transfer moulding processes.

It is preferable that fibers form the reinforcing component, the arrangement of these being more particularly directionally orientated within the parent material, their orientation preferably being such that they reinforce the mouthpiece in preferred fracture directions.

Good results are achieved with macroscopic fibers whose length is preferably from 2 to 3 mm. The ratio of the width of the fibers to their length is preferably from 1:4 to 1:5.

Instead of fibers or in addition to them particles having the shape of a plate or chips can be used. These chips can have any shape. Preferably they are quadratic.

In one embodiment, the entire mouthpiece has the reinforcing component. This method permits simple manufacture of the mouthpiece, more particularly in a single manufacturing step.

In another embodiment, at least one first zone of the mouthpiece has the reinforcing component, and at least one second zone of the mouthpiece has no reinforcing component. The location of this at least one first zone is more particularly in preferred fracture zones or bite-through zones of the mouthpiece. Thereby, the requirement for material for the reinforcing component is optimized. Moreover, this approach allows the remaining zones to be designed with extreme flexibility and softness.

The parent material is preferably a multicomponent material, where the first component is a main component. This first component is preferably silicone, in particular liquid silicone or solid silicone rubber.

The hardness of the first component is preferably from 15 to 50 Shore A, more particularly 20 Shore A. The hardness of the reinforcing component is from 50 to 90 Shore A, more particularly 70 Shore A.

The mouthpiece is preferably an item for sucking and chewing for babies and small children, or a constituent thereof. It is in particular a suction nipple for a bottle, a teat, a drinking spout, or a teething ring or any other article for chewing. However, it can also be a mouthpiece of an anaesthesia machine or of a ventilation device, or a mouthpiece of breathing equipment, for example of diving equipment.

The process of the invention for the production of a mouthpiece with an elastomeric parent material and with a bite-off-prevention feature encompasses the steps of:

use of a first component to form the elastomeric parent material, use of a reinforcing component for embedding into the parent material, where the reinforcing component derives from the same group of substances or group of materials as the first component, mixing of the first component and of the reinforcing component and introduction of the first component and of the reinforcing component into a shaping mould in order to mould the mouthpiece.

The first component and the reinforcing component here can be mixed prior to or during introduction into the shaping mould.

It is preferable that the reinforcing component is at least to some extent orientated during the mixing process or in the mixture. The reinforcing component becomes almost completely orientated in the shaping mould.

At least one further component can be used for the production of the parent material.

Other advantageous embodiments and variants of the process are apparent from the dependent patent claims.

BRIEF DESCRIPTION OF THE DRAWINGS

The subject matter of the invention is explained below using preferred examples, illustrated in the attached drawings.

Identical parts have been indicated by identical reference signs.

DETAILED DESCRIPTION

Figure 1:
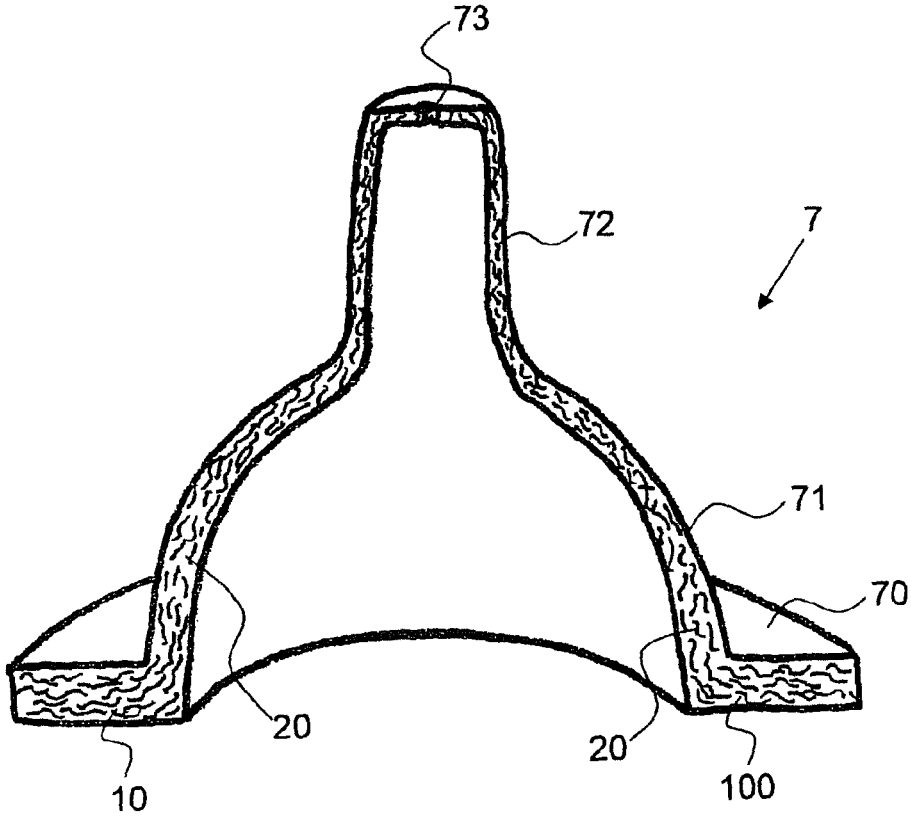
FIG. 1 shows a longitudinal section through the mouthpiece of the invention, in this case a suction nipple for a bottle.

FIG. 1 shows a suction nipple 7 for a bottle, representing all of the other mouthpieces described above. The nipple 7 has a conventional shape and is composed of a hollow main body 71 essentially in the shape of a truncated cone, with, at the bottom, an adjoining peripheral flange 70 and with, at the other, upper, end of the main body 71, an adjoining narrowed neck 72, the free end of which has at least one suction aperture 73.

The mouthpiece 7 has been manufactured from an elastomeric parent material 100, in which a reinforcing component 20 has been embedded. It is preferable that the reinforcing component 20 is composed of fibers which have been directionally orientated. As is discernible in FIG. 1, the fibers preferably run approximately parallel to the curved surface of the mouthpiece or to the fall line of the nipple, thus forming a bite-through-prevention feature, preventing biting through the wall of the mouthpiece. Instead of the fibers or in addition to them plates or chips can be used. The plates or chips can have a round, oval, rectangular or triangular shape, or any shape. The chips can have all the same size and shape or can vary in shape and size. Preferably, the chips are quadratic.

Figure 7:
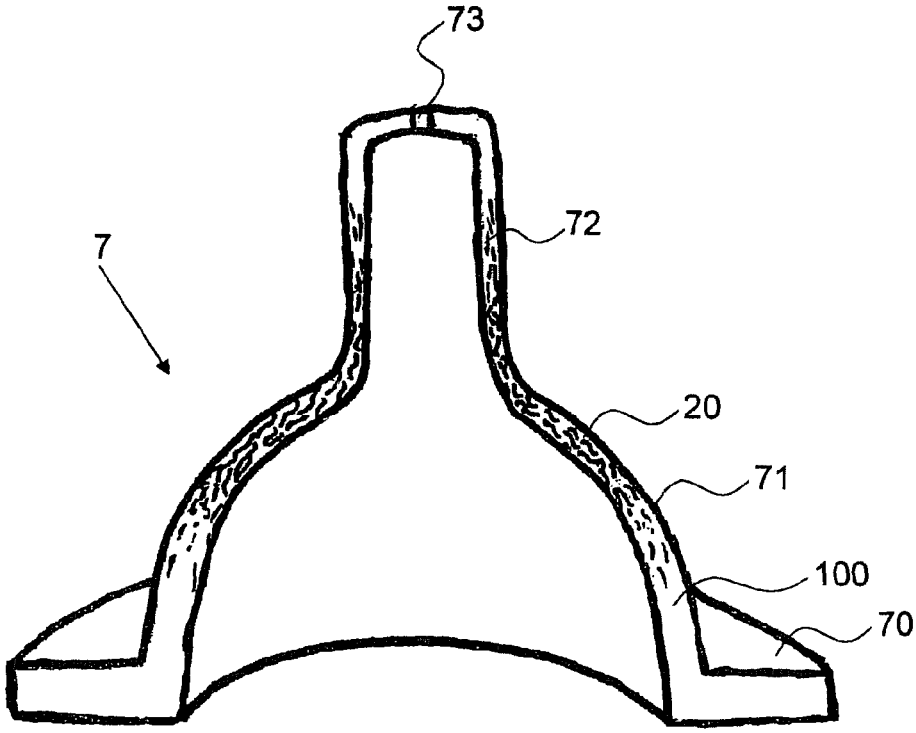
FIG. 7 shows a longitudinal section through a second embodiment of a suction nipple of the invention for a bottle.

In another embodiment, shown in FIG. 7, the mouthpiece has at least one first zone reinforced by the reinforcing fibers, and has at least one second zone free from reinforcing components. The reinforced zone is preferably the neck 72 of the mouthpiece 7 and at least the transition region from the neck 72 to the main body 71. The flange 70 has no reinforcement. The location of the reinforcement is therefore at least in the "bite-susceptible" region of the mouthpiece.

The parent material 100 is composed of at least one component, and preferably composed of two or more components, more particularly in order to increase crosslinking rate during the production process and in order to improve aging resistance. The known elastomers are a suitable parent material, more particularly silicone, preferably liquid silicone or solid silicone rubber, latex, solid rubber mixtures or thermoplastic elastomers. Reference is moreover made to the elastomeric materials described in the prior art cited above, which can likewise be used, as long as they are permissible for mouthpieces of this type. The hardness of the parent material is preferably from 15 to 50 Shore A, preferably 20 Shore A.

The at least one reinforcing component is derived from the same group of materials or group of substances as the abovementioned first component of the parent material, and is preferably orientable. By way of example, the at least one reinforcing component is composed of elongate elements, such as fibers. If by way of example, therefore, silicone or another thermoplastic elastomer is used as parent material, the reinforcing component is also silicone.

It is preferable that the reinforcing component is composed of short fibers whose length is from 2 to 3 mm. The ratio of the width of the fibers to the length is preferably from 1:4 to 1:5. The hardness of the reinforcing component is preferably from 50 to 90 Shore A, in particular 70 Shore A.

Mouthpieces of this type can be produced in various ways, and possible processes are more particularly injection moulding processes, compression moulding processes and transfer moulding processes. The processes used are in essence the known processes, and more particularly the single and multicomponent processes described in the abovementioned prior art, with admixture of suitable additives as required.

Figure 2:
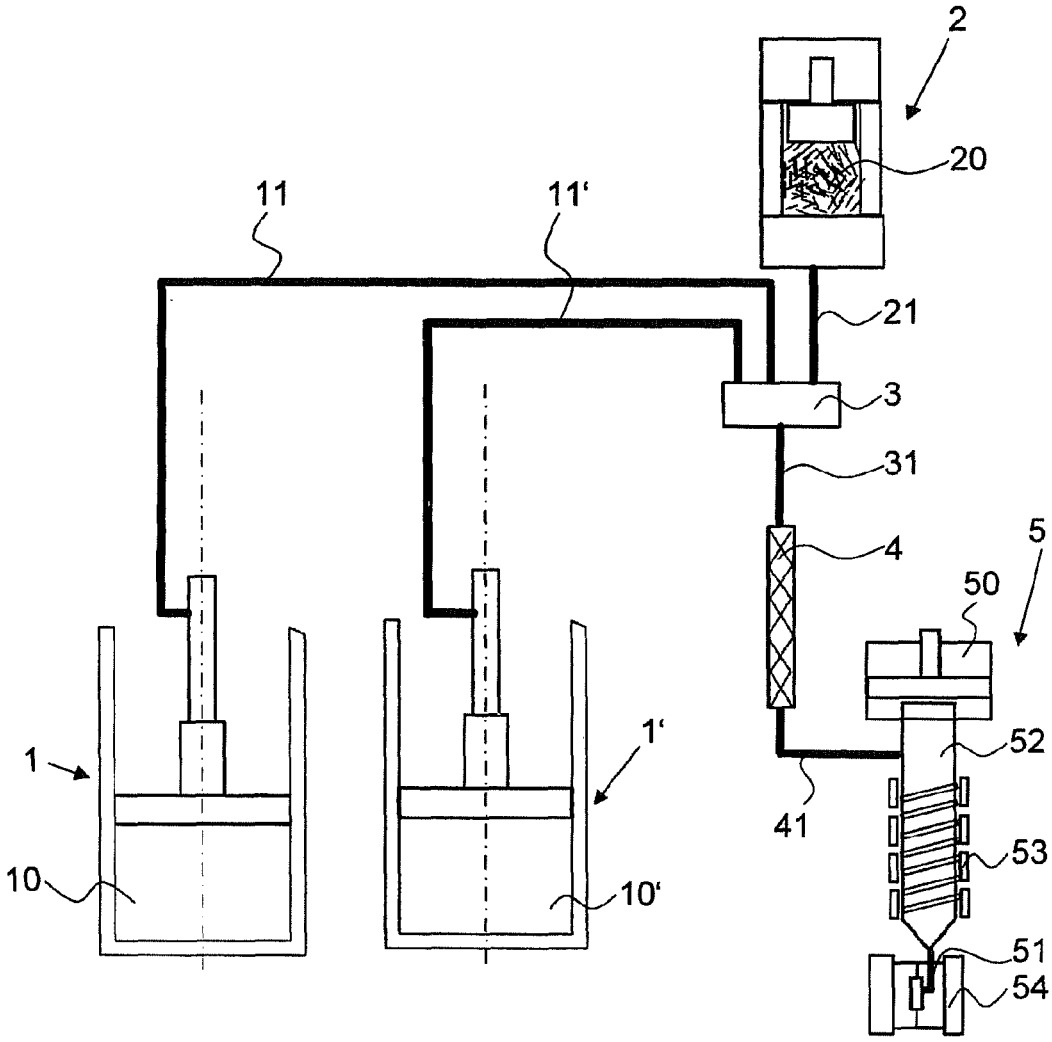
FIG. 2 is a diagram of an injection moulding system for the production of the mouthpiece of the invention according to a first variant of the process.

A first variant of a production process can be described in FIG. 2, using a diagram of an injection moulding system. The location of the first component 10, which preferably forms a main component of the resultant parent material 100, is in a first metering unit 1. A second metering unit 1' comprises a second component 10'. The two components 10, 10' are introduced by way of in each case a separate line, here called component line 11, 11', into a mixing chamber 3. There is at least one reinforcing component 20 located in at least one further metering unit 2. This is introduced to the mixing chamber 3 by way of a further line, here called reinforcing component line 21.

The mixing chamber 3 is a valve block, in which the ratio of the individual components introduced is controlled. In a further line, here called first mixing line 31, the individual components are introduced in the desired ratio into a static mixer 4. The static mixer 4 comprises mechanical mixing elements, such as agitators and screws. Here, the individual components are mixed completely with one another, before they are introduced together to the injection moulding machine 5 by way of a second mixing line 41.

The injection moulding machine 5 comprises the conventional regions or elements, such as ram 50, feed channel 51, screw 52, thermal elements 53 and an injection mould 54. Here, the mouthpiece is preferably manufactured in a single-stage injection moulding process.

Figure 3:
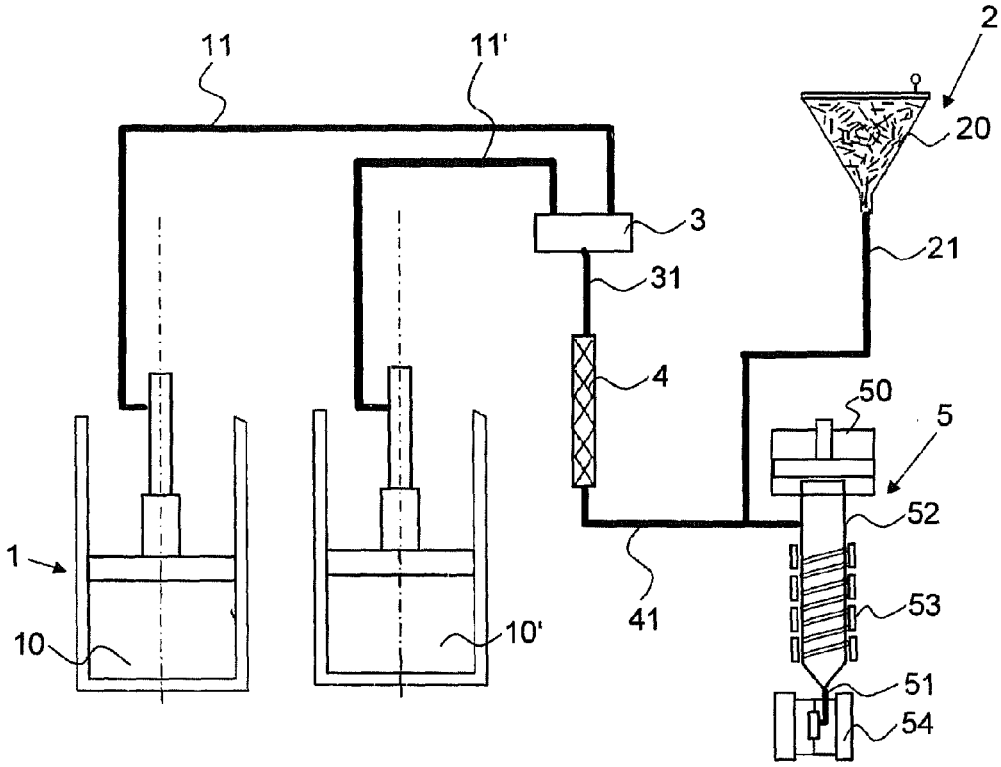
FIG. 3 is a diagram of an injection moulding system for the production of the mouthpiece of the invention according to a second variant of the process.

FIG. 3 shows a second variant of the production process. Here again, an injection moulding process is used. Identical parts therefore have identical reference signs. However, the at least one first component and the at least one second component 10, 10' here are first mixed by way of the mixing chamber 3 and the static mixer 4, and the reinforcing component 20 is introduced subsequently into this mixture. They then again pass together into the injection moulding machine 5.

Figure 4:
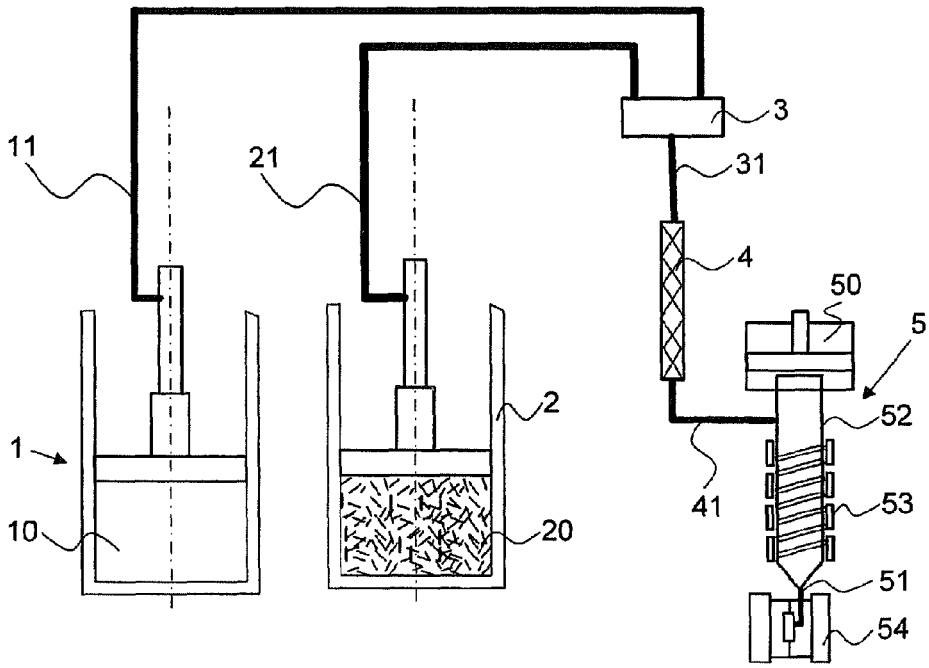
FIG. 4 is a diagram of an injection moulding system for the production of the mouthpiece of the invention according to a third variant of the process.

In the variant according to FIG. 4, which likewise shows an injection moulding process, the first component 10 and the reinforcing component 20 are mixed with one another. A component of the parent material is located in the second metering unit 2. If this is the first component, another component or the same component is present in the other metering unit indicated by 1 in the figure.

In all of these variants, partial or prior orientation of the reinforcing component 20 already takes place during mixing of the reinforcing component 20 and of the first component 10. Further orientation or final orientation takes place during injection into the injection mould or during the injection moulding process.

If only individual subregions of the mouthpiece are reinforced, this is achieved in that the preform itself comprises zones with fewer or no fibers.

Figures 5A, 5B, 5C:
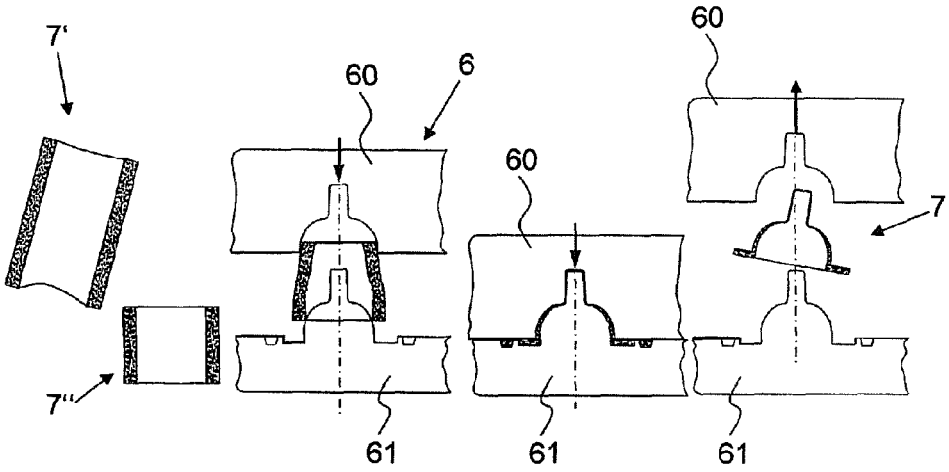
FIGS. 5*a* to 5*c* are diagrams of a compression moulding system for the production of the mouthpiece of the invention according to a fourth variant of the process in a first to third step of the process.

FIGS. 5*a* to 5*c* show a compression mould 6. Here, a preform 7' is used for the production of the mouthpiece 7, and has been previously extruded. This preform 7' is itself composed of the parent material with the at least one first component 10 and the at least one reinforcing component 20. By virtue of the extrusion process, the reinforcing component 20 has been at least to some extent orientated in the preform.

The preform 7' has a suitable shape, as a function of the desired final shape of the mouthpiece 7. Here, the shape is a section of a hollow cylinder. However, the perform 7' can also be conical or have any other shape. This preform is shortened to the desired length. The preform cut to length is indicated by the reference sign 7" in FIG. 5*a*. The cut-to-length preform 7" is then placed between two mould plates 60, 61 of the compression mould 6, and together form an inner cavity in the desired shape of the mouthpiece 7. The two or more mould plates 60, 61 are pressed together, as shown in FIG. 5*b*. The pressure on the preform 7" first compresses the preform 7" to the desired shape, and the reinforcing component is also orientated by the displacement of material and the external pressure. As shown in FIG. 5*c*, the mouth-piece 7 can then be removed between the mould plates 60, 61.

Figures 6A, 6B, 6C:
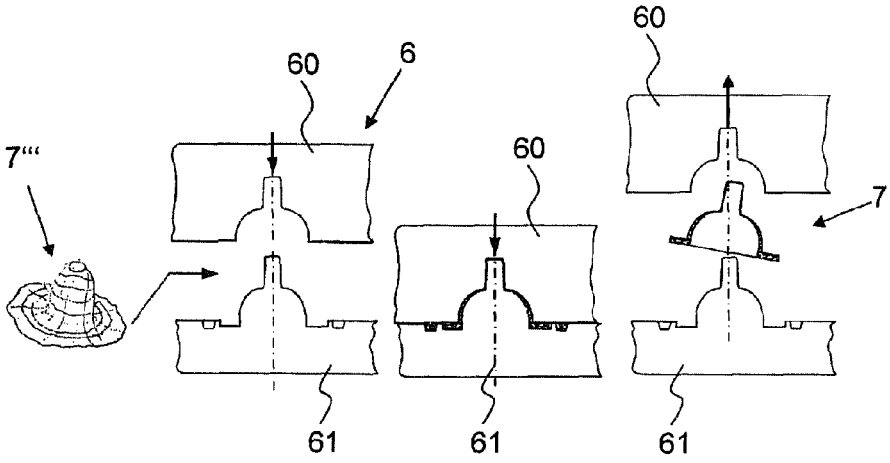
FIGS. 6*a* to 6*c* are diagrams of a compression moulding system for the production of the mouthpiece of the invention according to a fifth variant of the process in a first to a third step of the process.

In the variant according to FIGS. 6*a* to 6*c*, a pre-shaped preform 7'" is used instead of a preform 7' in the shape of a hollow cylinder. The preshaped preform 7'" can by way of example be manufactured by extrusion processes. Here again, the first component and the reinforcing component, and also any further components, have by this stage been mixed with one another. Here again, moreover, the reinforcing component preferably has at least some degree of orientation. The steps described above under FIGS. 5*a* to 5*c* for the process then follow; these are therefore not repeated in detail.

Three examples are given below.

EXAMPLE 1

Silicone Suction Nipple, Shore A Hardness 37/60

A liquid silicone rubber which is a 2-component mixture (Elastosil LR 3043, Shore A hardness 37, Wacker-Chemie GmbH) is homogeneously mixed with fully vulcanized silicone rubber fibers (Elastosil LR 3043, Shore A hardness 60, Wacker-Chemie GmbH).

The compression moulding process is used according to the invention to produce suction nipples from this mixture at a mould temperature of 165° C.

EXAMPLE 2

Silicone Suction Nipple, Shore A Hardness 20/70

A liquid silicone rubber which is a 2-component mixture (Med-4970, Shore A hardness 20, NuSil Technology Europe) is homogeneously mixed with fully vulcanized silicone rubber (Med-4920, Shore A hardness 70, NuSil Technology—Europe).

The compression moulding process is used according to the invention to produce suction nipples from this mixture at a mould temperature of 165° C.

EXAMPLE 3

Silicone Suction Nipple, Shore A Hardness 40/70

An HTV silicone mixture which is a 2-component mixture (Elastosil R plus 4000, Shore A hardness 40, Wacker-Chemie GmbH) is mixed homogeneously on mixing rolls with a crosslinking catalyst (PT 2) and with fully vulcanized silicone rubber fibers (Med-4920, Shore A hardness 70, NuSil Technology—Europe).

This mixture is used in the extrusion process to manufacture preforms which, in the shape of a cylindrical tube, are further processed according to the invention by the compression process at a mould temperature of 165° C. to give suction nipples.

The mouthpiece of the invention and the process of the invention for the production of a mouthpiece can provide a bite-through-protection feature in a simple manner, without greatly increasing the cost of the production process or greatly restricting the selection of materials.

The invention claimed is:

1. An injection molded mouthpiece having at least two zones, comprising:

a first zone comprising a bite-off prevention feature; and a second zone;

wherein the first zone and second zone are concurrently molded from an elastomeric parent material including directionally oriented reinforcing fibers;

and wherein the bite-off prevention feature of the first zone comprises a higher concentration of directionally oriented reinforcing fibers;

thereby yielding a first zone with greater hardness relative to the second zone.

2. The mouthpiece of claim 1, wherein the length of the fibers ranges from 2 to 3 mm.

3. The mouthpiece of claim 1, wherein the ratio of a width to a length of the fibers ranges from 1:4 to 1:5.

4. The mouthpiece of claim 1, wherein the elastomeric parent material includes silicone.

5. The mouthpiece of claim 1, wherein the hardness of the first zone ranges from 50 to 90 Shore A and the hardness of the second zone ranges from 15 to 50 Shore A.

6. The mouthpiece of claim 1, wherein the mouthpiece is a suction nipple comprising a main body and a flange, wherein the flange is within the second zone.

7. The mouthpiece of claim 1, wherein the mouthpiece has a curved surface, and wherein the reinforcing fibers run parallel to the curved surface of the mouthpiece.

8. The mouthpiece of claim 1, wherein the mouthpiece may be a teat, a drinking spout, a teething ring, or the mouthpiece of a ventilation device, an anesthesia machine, or breathing equipment.

* * * * *